US005492518A

United States Patent [19]

Measom

[11] Patent Number: 5,492,518

[45] Date of Patent: Feb. 20, 1996

[54] EXERCISE APPARATUS

[76] Inventor: S. Ty Measom, 1455 No. 1558 East, Logan, Utah 84321

[21] Appl. No.: 301,066

[22] Filed: Sep. 6, 1994

[51] Int. Cl.[6] ..... A63B 21/068

[52] U.S. Cl. ..... 482/96; 482/72; 482/133; 482/137; 482/138; 482/142

[58] Field of Search ..... 482/95–97, 131, 482/133, 138, 142, 72, 100, 137

[56] References Cited

U.S. PATENT DOCUMENTS

| | | | |
|---|---|---|---|
| 4,208,049 | 6/1980 | Wilson | 482/139 |
| 4,627,616 | 12/1986 | Kauffman | 482/137 |
| 4,793,608 | 12/1988 | Mahnke et al. | 482/142 |
| 5,029,848 | 7/1991 | Sleamaker | 482/96 |
| 5,312,313 | 5/1994 | Holmes et al. | 482/95 |
| 5,330,405 | 7/1994 | Habing et al. | 482/96 |
| 5,334,120 | 8/1994 | Rasmussen | 482/96 |
| 5,352,171 | 10/1994 | Lin | 482/142 |

OTHER PUBLICATIONS

The Gravity Edge, Owner's Manual, SLM Fitness, 1993.

*Primary Examiner*—Richard J. Apley
*Assistant Examiner*—Victor K. Hwang
*Attorney, Agent, or Firm*—Harris Zimmerman

[57] ABSTRACT

An exercise apparatus includes an upright column, with a translating shuttle assembly secured within a slot in the column. An adjustable seat is supported by the shuttle assembly. A collar is secured to the upper end of the shuttle assembly, and circumscribes the column assembly in freely translating fashion. A first pivot shaft is joined to the collar to secure one end of a main drive link in freely pivoting fashion. A handle pivot shaft secures a pair of handle members to a second pivot shaft atop the column assembly. A first mounting pin is adapted to releasably secure the other end of the main drive link to the handles at selectively variable distances from the first pivot shaft. Movement of the handles urges the main drive link upwardly to lift the shuttle assembly and the weight of the user. A leg exercise assembly includes a pair of leg struts joined in parallel spaced apart disposition to opposed ends of a third pivot shaft supported on the column. The proximal ends of the leg struts are provided with pedals to engage the feet of the user. A pair of linking members extend from the distal ends of the leg struts and are releasably secured to proximal ends of the handle members. A second mounting pin is adapted to releasably secure the other end of the main drive link to the leg struts at selectively variable distances from the third pivot shaft. The user pushes downwardly on the pedals and lifts the handles. The compound action of the handle effort transmitted through the linking members to the leg struts, and the pedal effort transmitted through the main strut to the collar and the shuttle assembly, lilts the weight of the user. The handles are then pushed down by the user to continue the cycle by rotating the pedals upwardly and driving the shuttle assembly and seat downwardly. This cycle may be reiterated for aerobic activity.

26 Claims, 8 Drawing Sheets

EXERCISE APPARATUS

BACKGROUND OF THE INVENTION

This invention relates to exercise apparatus for toning and building muscles in the human body, and more particularly to a new exercise machine that utilizes the weight of the user as a load factor to provide mechanical impedance for exercise.

In recent years exercise machines have gained a great deal of popularity with the general public. Whereas formerly such machines were used primarily by athletes for enhancing their performance in their chosen sport, exercise devices are now used by a large number of non-athletes for such purposes as conditioning, aerobic activity, and improvement in appearance through muscle-building activity. This growth in use of exercise machines has created an expanding market for home-based units, as well as installations in athletic clubs, fitness centers, resorts, cruise ships, and other recreational and sports facilities.

Several basic concepts are embodied in most exercise machines. The apparatus should be able to exercise as many muscle groups of the body as possible, to provide the most complete workout. In the prior art, some exercise machines are adaptable for total body workout, but reconfiguring the machine involves a level of mechanical ingenuity that many people do not possess. Furthermore, dismantling and reassembling portions of the machine requires some time, and these tasks interrupt the flow of a good physical workout and limit the aerobic quality of the activity. An ideal exercise machine should be adaptable to a total body aerobic workout without delays due to mechanical limitations of the machine itself. The prior art has been deficient in this respect. In health clubs and the like it is possible to provide a group of variously configured machines in a training circuit, each machine dedicated to a particular exercise or muscle group, so that an ongoing aerobic workout may be achieved by using the different machines serially. However, in home installations or the like economic necessity requires that a single machine provide all of the exercise potential of the plurality of machines, without significant interruption for reconfiguration.

Another design consideration for exercise machines is the need to provide a selectively variable mechanical resistance for the various muscle groups and movements required for exercising them. Impedance must be adjustable so that weaker individuals can undertake exercise without straining their muscles, while stronger individuals can select sufficient resistance to their exertions to provide meaningful exercise.

Early designs utilized discrete weights that could be added to a loading assembly that is lifted through cable and pulley arrangements. This system was improved by adding cam devices to vary the weight load during extension and retraction of the limbs during each exercise. Later machines have employed discrete springs or elastic bands to provide resistance to exertion, or fluid damping devices (pistons displacing air or liquid through a restricted orifice), which offers the ability to provide infinite variation in resistance. Mechanical resistance from sliding or rotating surfaces have also been used, although adjustability and reproducibility have been problematic. There is no clearly preferable mechanical impedance arrangement in the prior art. All of them must be readjusted for each new user of the machine; e.g., a 170 lb. person must readjust the weights, elastic bands, or dampers of any machine when the previous user was a 120 lb. individual.

Another important design consideration is the safety of the apparatus. Falling weights, breaking elastic bands, or failing mechanical or fluid dampers can result in uncontrolled movement of the machine. The result can be hyperextension of joints, or impact and injury to the individual using the machine.

To summarize the state of the art in exercise machines, there is a design ideal involving adaptability, adjustability, ease of use, and safety. This ideal has not been met by any one device, and many devices have fallen far short of the ideal.

SUMMARY OF THE INVENTION

The present invention generally comprises an exercise apparatus that is designed to provide an aerobic, total body workout for an individual. Salient features of the invention are that many muscle groups of the body may be exercised with a minimum of mechanical reconfiguration of the apparatus, and that the resistance to exertion provided by the apparatus is provided solely by the weight of the individual using the apparatus. This feature aids in scaling the exercise resistance to the user with less reconfiguration than prior art apparatus.

The apparatus includes an upright column assembly supported on a stable base. The column assembly includes a slot extending vertically in one side thereof, with a track extending longitudinally within the slot. A shuttle assembly is secured within the slot and is provided with wheels that engage the track and permit the shuttle assembly to translate therealong. Alternatively, the shuttle assembly may include roller bearings or linear bearings that engage the outer surface of the column assembly. A seat support is joined to a lower end portion of the shuttle assembly, extending laterally out through the slot and supporting a seat and foot support at the outer end thereof. The seat is adjustably positioned on its support to accommodate persons of varying size, and may be rotated 180° to increase the variety of exercise options. A collar member is secured to the upper end of the shuttle assembly, and circumscribes the column assembly in freely translating fashion.

The column assembly includes a first pivot shaft secured laterally to the upper end thereof. A pair of handle members is secured to the first pivot shaft at opposed sides of the column assembly. Joined to the collar assembly is a second pivot shape adapted to secure one end of a main drive link in freely pivoting fashion. The handle members are enantiomorphic, with flaring proximal ends that are disposed generally above the seat, and tubular grips extending laterally from the proximal ends. The tubular grips are swivel mounted on the handle members to provide wrist flexure during use. The handle members each include a plurality of holes spaced along the distal extent thereof, with a first mounting pin extending through like holes of the opposed handles. The first mounting pin is adapted to releasably secure the other end of the main drive link to the handles at selectively variable distances from the second pivot shaft. This arrangement permits a person to sit on the seat or stand on the foot support and grasp the handle grips to push or pull on the handles and exercise various arm and shoulder portions of the body.

As the user pushes or pulls the handle grips toward the seat, the distal end of the handle assembly is driven upwardly, pulling the main drive link upwardly and lifting the shuttle assembly. The shuttle assembly supports the seat assembly, so that the resistance to this exercise comprises the weight of the user supported on the seat assembly. The user may be seated facing toward or away from the column assembly, and perform pull-down exercises on the handles to stimulate the abductors of the arms and shoulders. The user may also stand on the foot support and push down on the handle grips to perform a modified dip exercise that stimulates the adductor muscles of the arms and shoulders. The spacing of the first mounting pin from the first pivot shaft permits the user to select the degree of difficulty in these exercises by altering the mechanical advantage of the arrangement. The resistance may range from 25% of body weight to approximately 100% of body weight.

The apparatus further includes a leg exercise assembly. A third pivot shaft is supported by a bracket member joined to a lower end portion of the column assembly, on a side of the column opposed to the shuttle assembly slot. A pair of leg struts are provided, each curved in dogleg fashion, and joined in parallel spaced apart disposition to opposed ends of the third pivot shaft. The proximal ends of the leg struts are provided with pedals to engage the feet of the user, the pedals being spaced apart approximately the same distance as the handle grips and disposed generally therebelow. A pair of linking members are provided, each extending from the distal end of one of the leg struts and releasably secured to a respective proximal end of a handle member. The leg struts each include a plurality of holes spaced along the distal extent thereof, with a second mounting pin extending through like holes of the opposed struts. The second mounting pin is adapted to releasably secure the other end of the main drive link to the leg struts at selectively variable distances from the third pivot shaft. This arrangement permits the user to perform arm and leg exercises together for a total body aerobic workout.

With the user seated on the seat, feet placed on the pedals and hands engaging the hand grips, the user pushes downwardly on the pedals and lifts the handles. The compound action of the handle effort transmitted through the linking members to the leg struts, and the pedal effort transmitted through the main strut to the collar and the shuttle assembly, lifts the weight of the user. As the seat rises, the legs of the user become fully extended against the pedals. The handles are then pushed down by the user to continue the cycle by rotating the pedals upwardly and beginning to drive the shuttle assembly and seat downwardly. This cycle may be reiterated for lengthy periods of time, creating an aerobic activity that involves the arms and legs in muscle-stimulating activity. The variable spacing of the second mounting pin from the third pivot shaft permits the user to select the degree of difficulty in these exercises by altering the mechanical advantage of the arrangement Alternatively, the linking members from the leg struts may be disconnected from the handle members. A removable handle is secured to the collar member, and the user grasps the removable handle and pushes downwardly on the pedals against the weight resistance provided by the main drive link connection to the shuttle mechanism. This configuration provides greater exercise for the legs, since the arms are not involved in exerting any lift on the weight load.

DESCRIPTION OF THE PREFERRED EMBODIMENT

Figure 1:
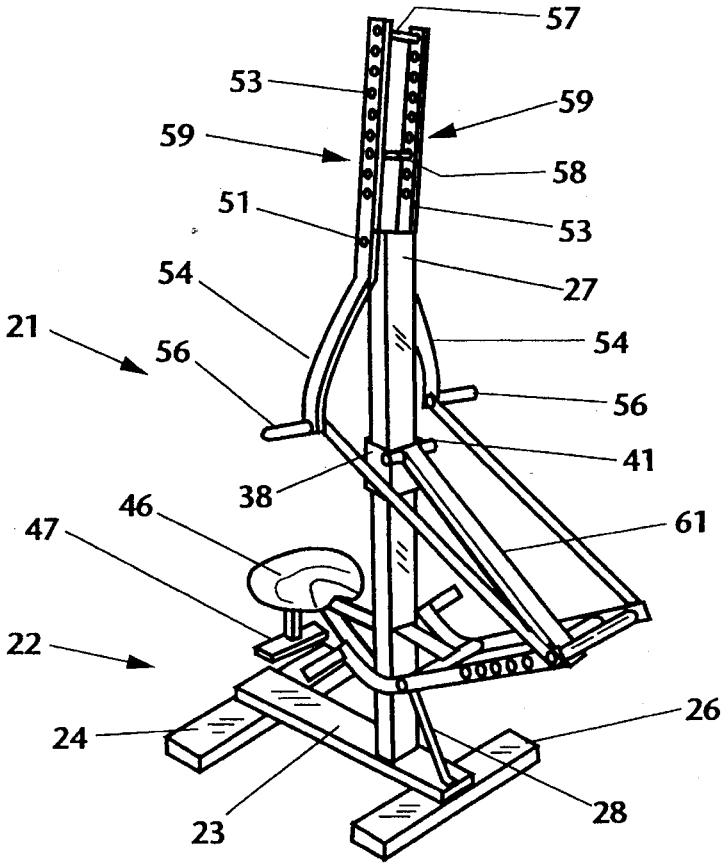
FIG. 1 is a perspective view of the exercise apparatus of the present invention, shown configured to provide aerobic leg and upper body exercise.

The present invention generally comprises an exercise apparatus that is designed to provide an aerobic, total body workout for an individual. With regard to FIGS. 1 and 3–6, the apparatus 21 includes a base assembly 22 comprised of a beam 23 rigidly secured to a pair of ground-engaging feet 24 and 26. Extending upwardly from the beam 23 is a column assembly 27 which supports all of the moving components of the apparatus 21. A brace 28 extends from the beam 23 to provide firm support for the column assembly 27.

Figure 2:
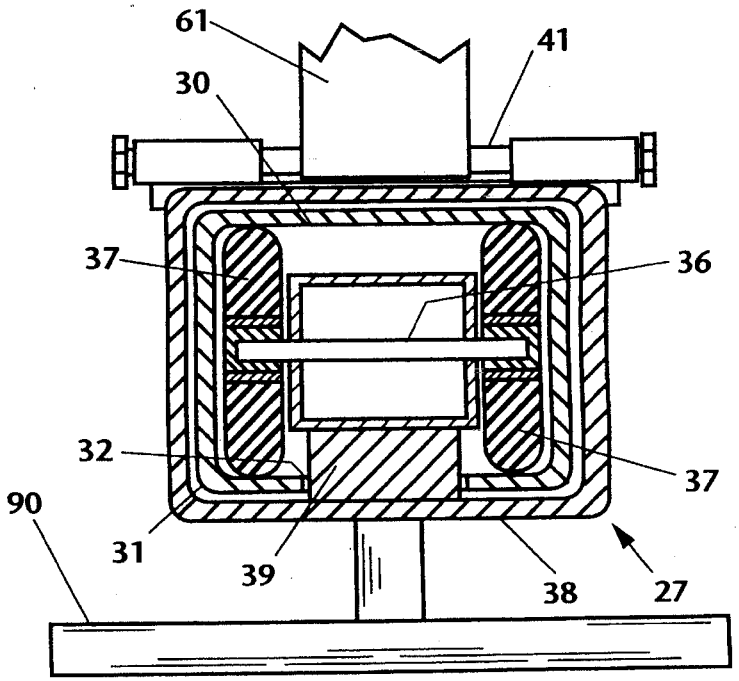
FIG. 2 is a horizontal cross-sectional view of the column assembly together with the shuttle assembly and main strut mounting assembly.
Figure 5:
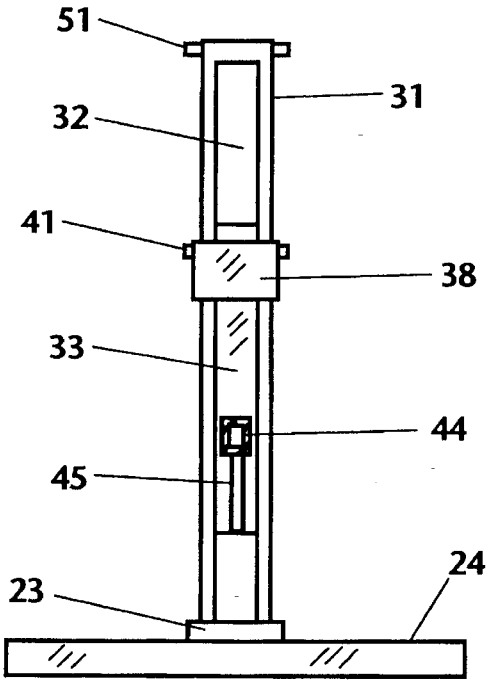
FIG. 5 is a partial front elevation of the column assembly, showing the shuttle assembly secured in the column slot.
Figure 6:
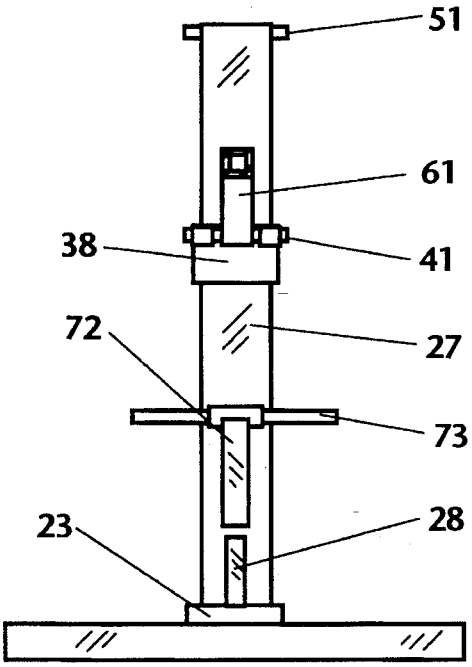
FIG. 6 is a partial rear elevation of the column assembly, showing the mounting of the leg strut assembly pivot shaft and the main strut connection to the collar assembly.
Figure 8:
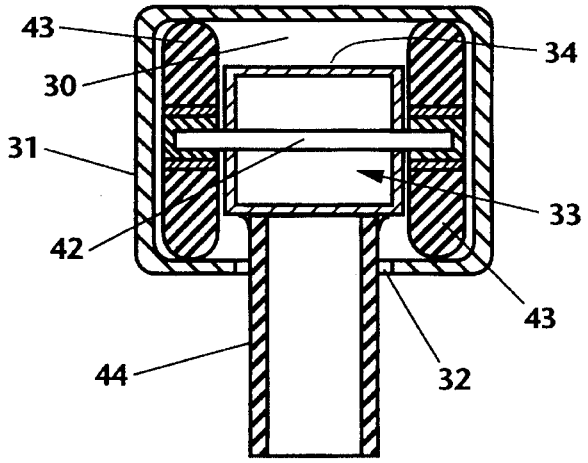
FIG. 8 is a horizontal cross-sectional view of the column assembly together with the shuttle assembly and seat support tube.

With reference to FIGS. 2, 5 and 8, the column assembly 27 comprises a tubular beam 31 having a generally rectangular cross-sectional configuration and a hollow interior space 30. A slot 32 is formed in one side of the beam 31, extending vertically the length of the beam, and providing an opening to the interior space 30. Disposed within the interior space 30 is a shuttle assembly 33 which is adapted to translate vertically therein. The shuttle assembly 33 includes a tubular beam 34 extending coaxially within the beam 31. At the upper end of the beam 34 a shaft 36 is secured horizontally to support a pair of roller wheels 37 on ball bearing races. The wheels 37 are disposed to engage the inner surface of the beam 31 in track-like fashion and roll therealong in free translation.

A collar 38 is joined to the upper end of the beam 34 by a bracket 39 that extends from the beam 34 through the slot 32. The collar 38 circumscribes the outer beam 31 and is dimensioned to provide clearance therebetween, so that the collar 38 translates vertically freely along the beam 31 in concert with the shuttle assembly. Secured to the upper extent of the collar 38 is a pivot shaft 41, the function of which is explained below. The shaft 41 is laterally opposed to the bracket 39. At the lower end of the beam 34 a shaft 42 is secured parallel to the shaft 36 to support a pair of roller wheels 43 on ball bearing races. The wheels 43 are also disposed to engage the inner surface of the beam 31 in track-like fashion and roll therealong in tree translation.

Figure 15:
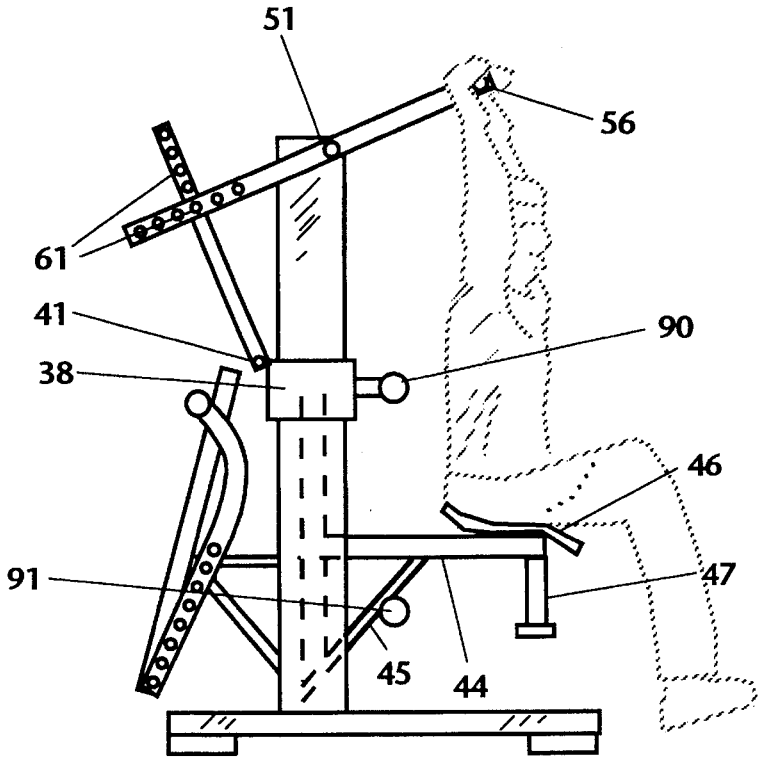
FIG. 15 is a side elevation showing the apparatus configured for use in a rear pull down exercise.

A seat support beam 44 is joined to a lower end portion of the beam 34 and extends generally horizontally through the slot opening 32. A brace 45 extends obliquely from the lower end of the beam 34 to a medial portion of the seat beam 44 to provide rigid support therefor. A seat 46 is secured to the distal end of the beam 44 at the upper surface thereof, and a pin-pull arrangement permits the seat to be selectively positioned along the support 44 for individuals of different size, as shown in phantom line in FIG. 7. The seat may also be rotated 180° about a vertical axis, as depicted in FIG. 15. A foot step 47, comprising an inverted T-shaped support, is secured in depending fashion from the distal end of the seat support beam 44. It may be appreciated that the seat 46 and step 47, together with the collar 38 and the pivot shaft 41, all move in concert with the shuttle assembly 33 along the column 27 in freely translating, reciprocating fashion.

Figure 3:
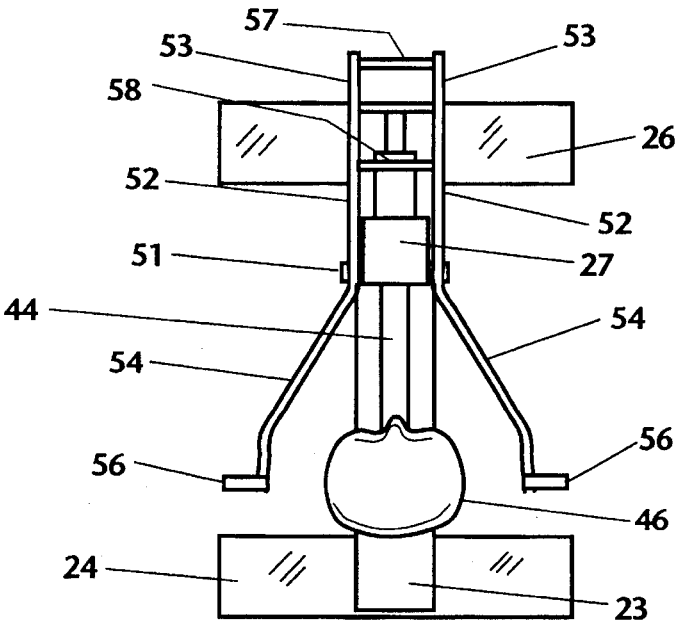
FIG. 3 is a partial plan view showing the column assembly and base together with the handle assembly and seat assembly.

Secured to the upper end of the column assembly 27 is a handle pivot shaft 51, with end portions extending outwardly from opposed sides of the column assembly, as shown in FIG. 3. A pair of handles 52 are secured at medial portions thereof to the opposed ends of the shaft 51. Each handle 52 includes a generally linear distal portion 53 and an outwardly flaring proximal end 54 extending toward and superjacent to the seat 46. A pair of tubular hand grips 56 are secured in swivel fashion to the opposed proximal ends of the handles for manual engagement by the user of the apparatus. A link 57 joins the distal ends of the handles 52 to form a rigid unit. With regard to FIGS. 1 and 7, the distal portions 53 are provided with a plurality of holes 59 in paired, opposed relationship. A mounting pin 58 is removably secured between the portions 53 in a pair of the opposed holes 59, whereby the pin 58 may be selectively positioned at various distances from the handle pivot shaft 51.

Figure 7:
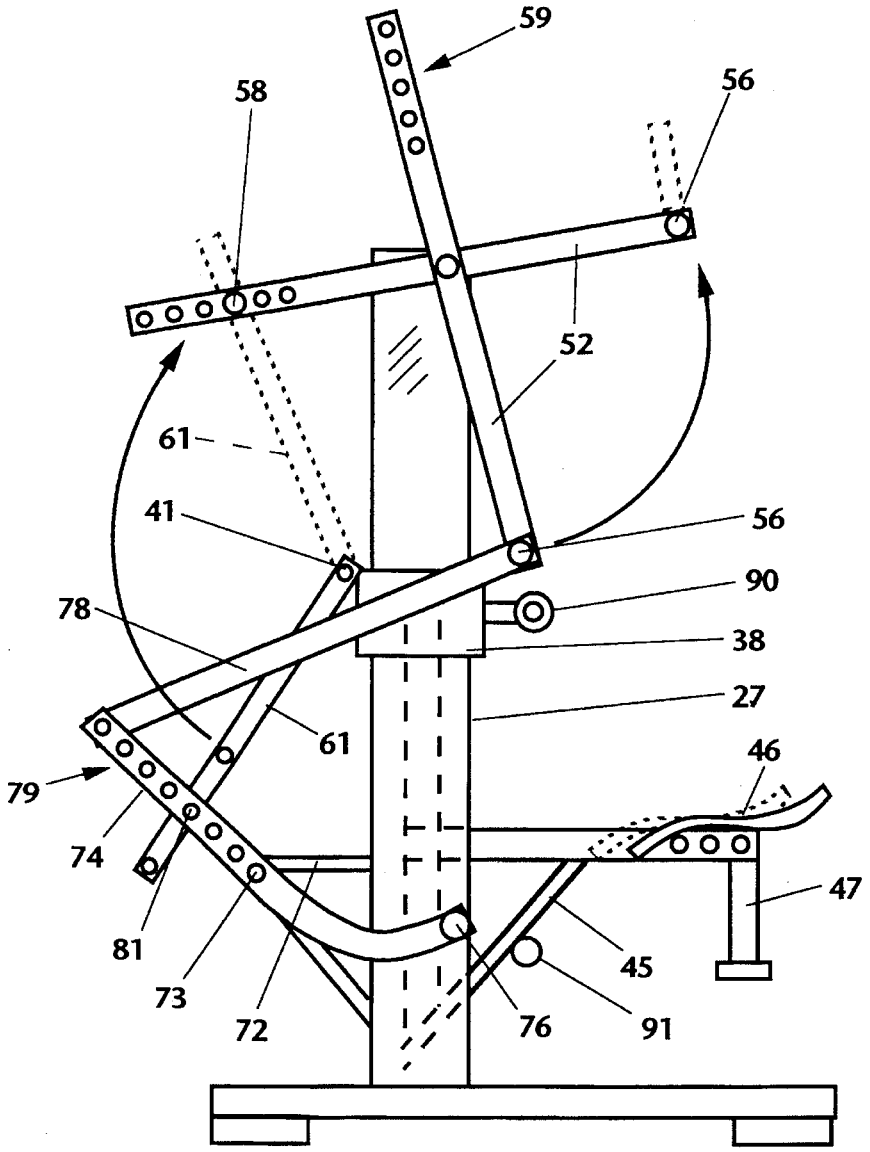
FIG. 7 is a schematic side elevation showing the movement relationships of the handle members and the main strut.
Figure 9:
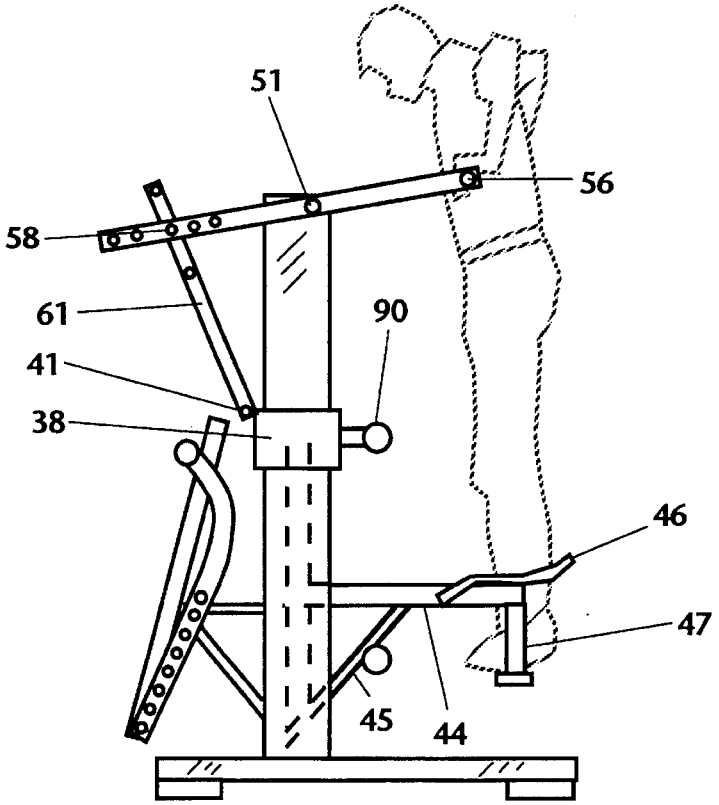
FIGS. 9 and 10 are sequential side elevations showing the apparatus configured for use in upper body exercise.
Figure 10:
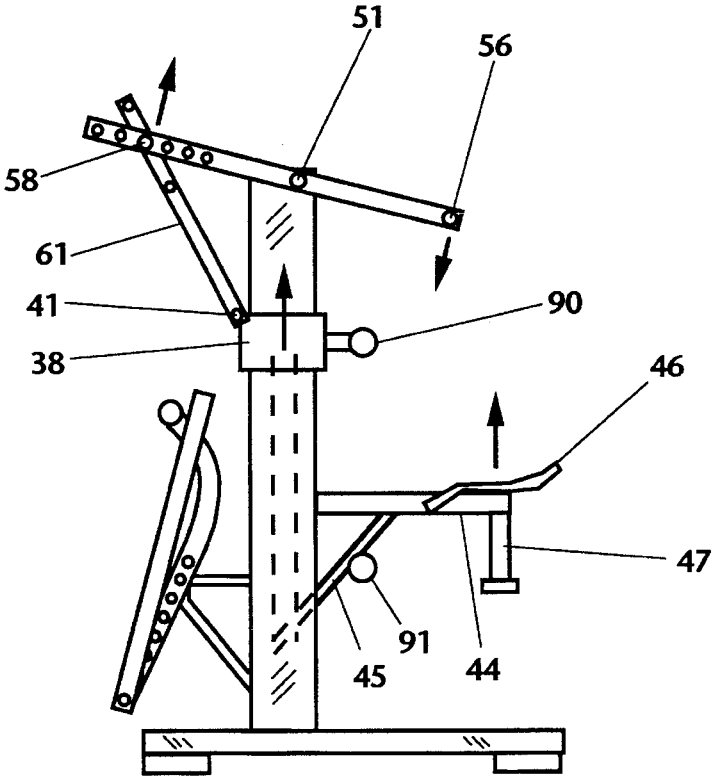

A main drive link 61 includes a proximal end that is joined to the pivot shaft 41, as shown in FIG. 2. The distal end of the rigid link 61 is removably connected to the mounting pin 58, which is secured between the handle members in a selected pair of holes 59, as shown in FIGS. 7, 9 and 10. The link 61 thus may be configured to join the handle members to the shuttle assembly, whereby motion imparted to the handles by the user of the apparatus is transferred to the shuttle assembly and the seat supported thereby, so that the weight of the user supported on the seat comprises a load opposing the handle motion.

Figure 14:
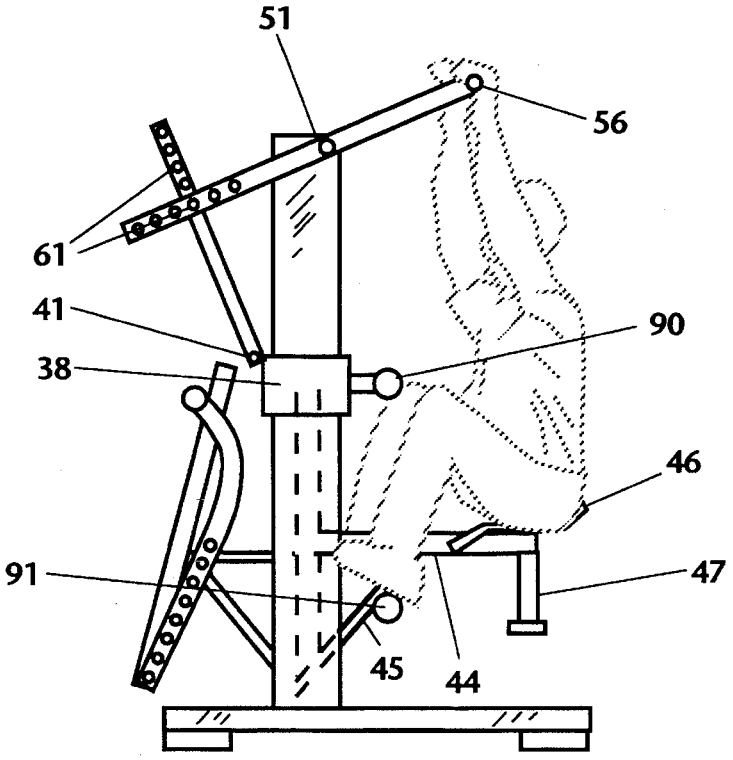
FIG. 14 is a side elevation showing the apparatus configured for use in a front pull down exercise, with the foot rest in use.

For example, with regard to FIGS. 9 and 10, the shuttle assembly with the seat and collar are normally disposed in the lower position of FIG. 9. The main drive link 61 is connected to the handle members, which are generally horizontal (depending somewhat on the pair of holes 59 selected for the pin 58). An individual standing on the foot support 47 may push down on the hand grips 56, rotating the proximal ends downwardly and raising the distal ends of the handles. The upward motion of the distal ends acts through the main link 61 to raise the shuttle assembly, thus lifting the weight of the user (FIG. 10). With regard to FIG. 14, the apparatus further includes a fixed foot rest 91 secured to the brace 45 and extending laterally therefrom. A person may be seated on the seat 46 facing the column assembly 27, with the feet supported on the rest 91. The person may pull down on the hand grips 56 against the individual's own weight to perform a front pull down (the equivalent of a pull-up on a horizontal bar), thereby exercising the upper body muscle groups. By selecting the spacing of the pin 58 from the pivot shaft 51, the user may select the mechanical advantage of the apparatus to provide a resistance in the range of 25% to 100% of the body weight of the user. Thus fitness and strength may be built up progressively using increased resistance. For even greater load, additional weight may be secured to the foot step 47 or to the seat support tube 44 to augment the weight of the user. Thus significant upper body muscle groups may be exercised using this configuration of the apparatus.

The same apparatus configuration with the seat rotated 180°, as shown in FIG. 15, may be used to perform a rear pull down exercise. Thus the upper back muscle groups may be involved as well as the muscles of the arms and shoulders.

Figure 4:
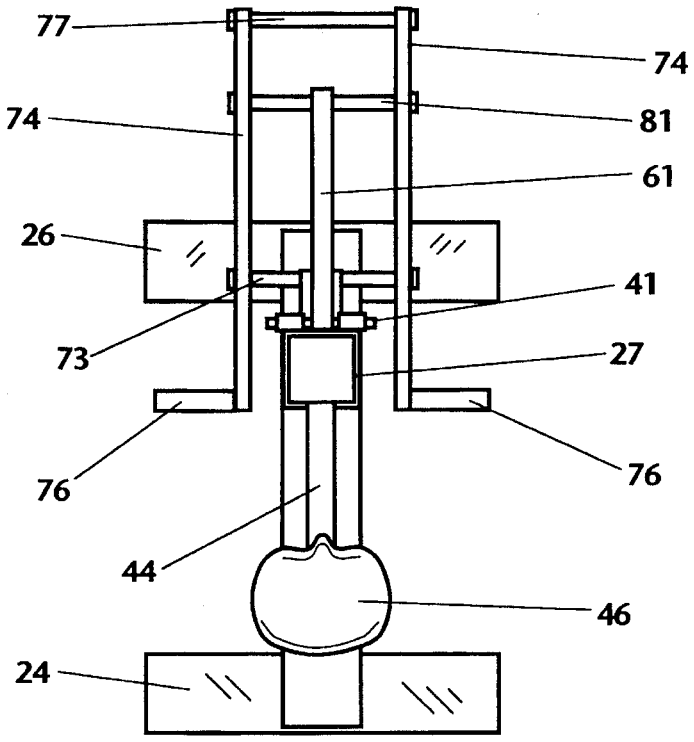
FIG. 4 is a partial plan view showing the column assembly and base assembly together with the leg strut assembly and seat assembly.

The apparatus 21 further includes a leg exercise assembly 71, as shown particularly in FIGS. 1, 4, and 7. A bracket 72 extends from a lower portion of the column assembly 27 to support a pivot shaft 73 disposed horizontally and below the pivot shaft 41. A pair of leg struts 74 are provided, each including proximal portions curved in dogleg fashion, and disposed in parallel, spaced apart fashion. The leg struts are joined at medial portions thereof to opposite ends of the shall 73. A pair of pedal assemblies 76 are provided, each secured to the proximal end of one of the leg struts. The pedals 76 are spaced apart approximately the same distance as the hand grips 56, which is generally the hip/shoulder width of an average person. A link 77 is secured between the distal ends of the leg struts to form a rigid assembly. A pair of linking members 78 have distal ends secured to respective distal ends of the leg struts 74 by the link 77, and proximal ends that are releasably secured to the proximal ends of respective handle members by bolts or pins.

The distal end portions of the leg struts 74 are provided with a plurality of mounting holes 79 spaced therealong in opposed pairs. A mounting pin is dimensioned to be releasably secured between the leg struts in a selected pair of opposed holes 79. The mounting pin 81 may be extended through the distal end of the main link 61 (when the main link 61 is not engaged with the pin 58 of the handle assembly) to secure the main link 61 between the collar 38 and the leg strut assembly. This connection couples the motion of the distal ends of the leg struts to the shuttle assembly, and the linking members couple the motion of the proximal ends of the handle members to the distal ends of the leg struts. This configuration permits the user to perform arm and leg exercises concurrently for a continuous, total body aerobic workout.

Figure 11:
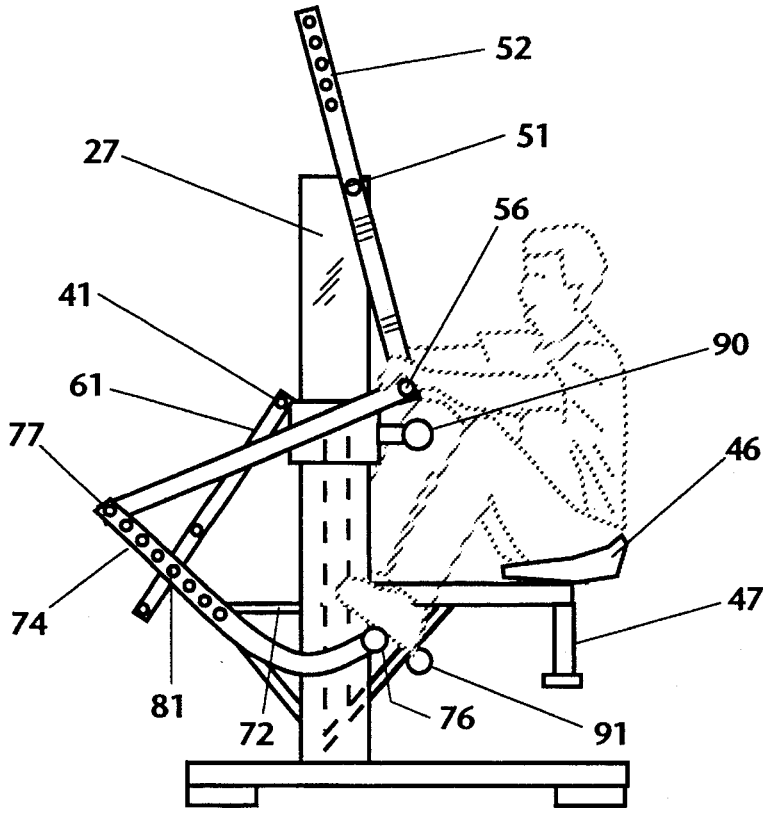
FIGS. 11 and 12 are sequential side elevations showing the apparatus configured for aerobic simultaneous upper body and leg exercise.
Figure 12:
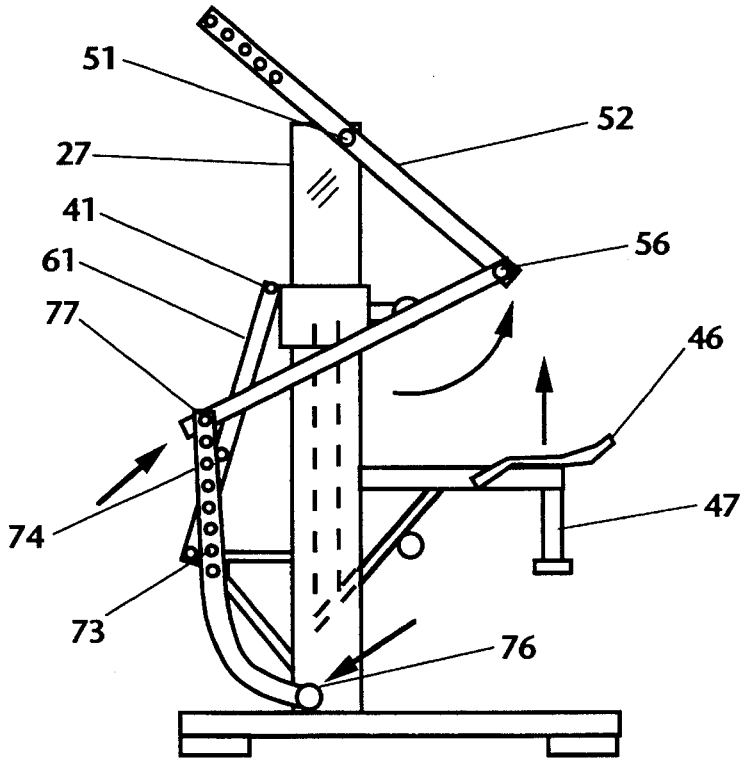

With regard to FIGS. 11 and 12, the user is seated on the seat 46, with the shuttle assembly 33, seat, and collar 38 disposed at the bottom of the slot 32. The proximal ends 54 of the handles are disposed downwardly to be joined with the linking members 78, and the leg struts are disposed so that pedals 76 are proximate to the user, as shown in FIG. 11. The user engages the feet on the pedals and pushes with the legs while at the same time lifting on the hand grips 56, both efforts acting to rotate the distal ends of the leg struts upwardly. This action urges the main link 61 upwardly, lifting the collar 38 and shuttle assembly in opposition to the weight load of the user. The seat and the user are thus lifted upwardly, as shown in FIG. 12, which also permits the user to fully extend the legs. As the pedals become rotated fully downwardly and the handle reaches its maximum upward position, the user begins to pull downwardly on the hand grips while genuflecting the knees, permitting the apparatus to return to the configuration of FIG. 11. The cycle may be repeated reiteratively to form a continuous exercise that may be sustained for a long period of time for maximum aerobic benefit. The selective positioning of the mounting pin 81 at various distances from the pivot shaft 73 determines the mechanical advantage of the linkages and permits the user to adjust the resistance to motion as a percentage of the user's weight, generally from 25% to 125% thereof.

Figure 13:
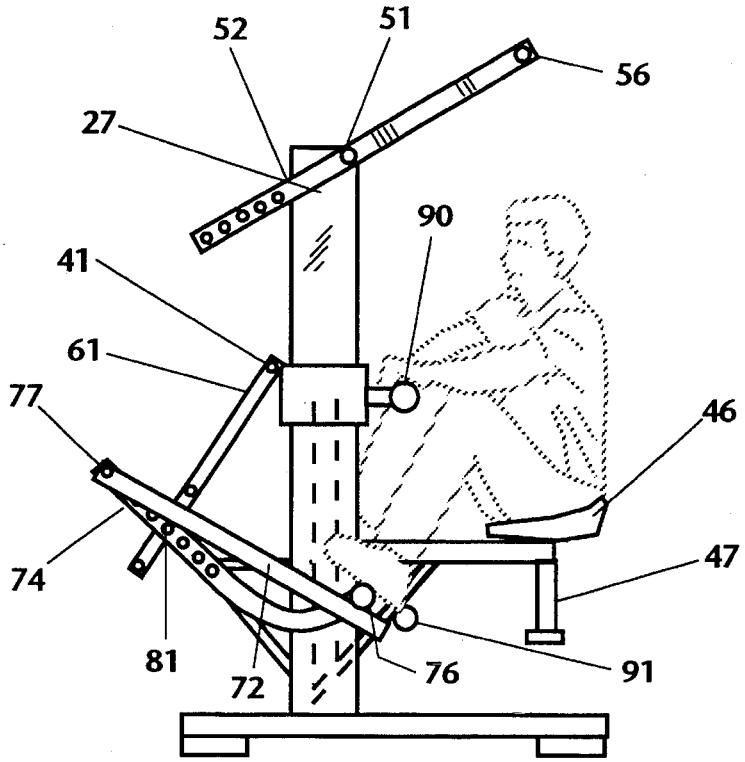
FIG. 13 is a side elevation showing the apparatus configured for use in a lower body leg press exercise.

With reference to FIG. 13, the apparatus may also be configured to provide a leg press exercise that does not involve the arms and upper body, and which creates a greater muscle-building load for the legs. The linking members 78 may be disconnected from the handle members, which are rotated away from the user and are not employed in the exercise. The main link 61 remains connected from the leg strut assembly to the collar assembly 38. A removable handle 90 is joined laterally to the collar assembly. The person using the apparatus places the feet on the pedals 76, and grasps the handle 90 with both hands for upper body support. The person then extends the legs against the pedals, pushing to raise the shuttle assembly against the individual's weight. Relaxing the legs permits the shuttle assembly to descend, and the exercise may be reiterated indefinitely.

Reconfiguring the apparatus from the upper body exercise arrangement of FIGS. 9 and 10 to the total body exercise arrangement of FIGS. 11 and 12, to the leg press exercise arrangement of FIG. 13 is mechanically simple. The linking members 78 are joined at their proximal ends to the handles 52, and the main link 61 is released from the mounting pin 58 and joined to the mounting pin 81 of the leg strut assembly. Any form of threaded fastener or quick-release coupler known in the prior art may be used to make these connections. When the leg strut assembly is not needed, it may be folded out of the way as shown in FIGS. 9 and 10.

Figure 16:
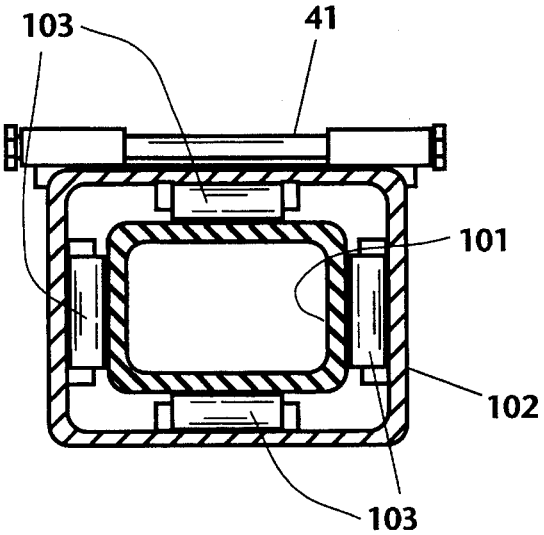
FIG. 16 is a cross-sectional view of an alternative embodiment of the column assembly and collar assembly.

An alternative embodiment of the column assembly, shown in FIG. 16, includes a tubular box-rail column 101 extending upwardly from the base described previously. A collar 102 comprises a rectangular member circumscribing the column 101 and spaced apart therefrom. A quartet of roller bearings 103 are secured within the collar 102 and disposed each to impinge on one of the surfaces of the column 101. The pivot shaft 41 is supported on the collar as described previously to enable linking the collar 102 to the leg strut assembly or the handle assembly. The lower end of the shuttle assembly is similarly constructed, with the seat support extending from a lower collar member similarly supported by roller bearings on the column 101. The two ends of the shuttle assembly may be joined externally of the column 101. The direct bearing support of the shuttle assembly on the column 101 permits low friction translation of the shuttle, creating a smooth motion for the apparatus.

Figure 17:
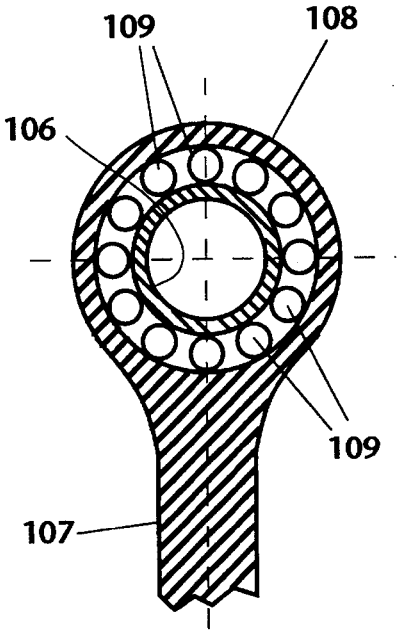
FIG. 17 is a cross-sectional view of another embodiment of the column assembly and seat support.

Another alternative embodiment of the column assembly, depicted in FIG. 17, includes a tubular cylindrical column 106 extending from the base assembly described above. A support ring 108 circumscribes the column 106 and is spaced apart therefrom, with a seat support 107 extending generally radially outwardly from the ring 108. A linear ball bearing assembly 109 is secured within the ring 108 and disposed to engage the surface of the column 106. At the upper end of the shuttle assembly, an upper ring is disposed about the column and supported by another linear ball bearing assembly, and the shaft 41 is secured to the upper ring. As in the previous embodiment, the two ends of the shuttle assembly may be joined externally of the column 106.

It may be appreciated that the exercise apparatus described herein obviates the use of mechanical or fluid resistance devices, elastic bands and springs, stacks of metal weights, or the like. Likewise, no flywheel mechanism is required to provide a sustained aerobic exercise. Thus the apparatus is simpler and easier to use than prior art arrangements.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

What is claimed is:

1. An exercise apparatus, including;

a rigid frame assembly;

ground-engaging base means for supporting said rigid frame assembly;

means for supporting the weight of an individual using said exercise apparatus, including shuttle means engaged with said rigid frame assembly and adapted to undergo upright translation with respect to said rigid frame assembly and translate the individual therewith;

a handle assembly;

first pivot means for securing said handle assembly to said rigid frame assembly, said handle assembly disposed to be engaged by the individual using said exercise apparatus and rotated reversibly about said first pivot means; and drive link means for transmitting force under tension and directly coupling said handle assembly to said shuttle means, whereby motion imparted to said handle assembly directly translates said shuttle means and exerts lift against the weight of the individual using said exercise apparatus.

2. The exercise apparatus of claim 1, wherein said rigid frame means includes a column assembly extending upwardly from said base means.

3. The exercise apparatus of claim 2, wherein said column assembly includes means for guiding said upright translation of said shuttle means.

4. The exercise apparatus of claim 3, wherein said means for guiding said upright translation includes a slot opening extending longitudinally in said column assembly, said shuttle means being disposed within said slot opening in freely translating fashion.

5. The exercise apparatus of claim 4, wherein said means for supporting the weight includes a first strut extending laterally from said shuttle means, and a seat secured to a distal end portion of said first strut.

6. The exercise apparatus of claim 5, further including a foot step secured to said distal end portion of said first strut.

7. The exercise apparatus of claim 4, wherein said shuttle means includes a plurality of wheels disposed to engage inner surfaces of said slot opening in freely rolling translation.

8. The exercise apparatus of claim 3, further including a collar assembly secured to said shuttle means and extending about said column assembly, and second pivot means supported by said collar assembly.

9. An exercise apparatus, including;

a rigid frame assembly;

ground-engaging base means for supporting said rigid frame assembly;

means for supporting the weight of an individual using said exercise apparatus, including shuttle means engaged with said rigid frame assembly and adapted to undergo upright translation with respect to said rigid frame assembly:

a handle assembly;

first pivot means for securing said handle assembly to said rigid frame assembly, said handle assembly disposed to be engaged by the individual using said exercise apparatus and rotated reversibly about said first pivot means:

drive link means for coupling said handle assembly to said shuttle means, whereby motion imparted to said handle assembly translates said shuttle means and exerts lift against the weight of the individual using said exercise apparatus:

said rigid frame including a column assembly extending upwardly from said base means:

said column assembly includes means for guiding said upright translation of said shuttle means; and a collar assembly secured to said shuttle means and extending about said column assembly, and second pivot means supported by said collar assembly;

said drive link means including a main drive link having a proximal end secured to said second pivot means and a distal end releasably secured to said handle assembly.

10. The exercise apparatus of claim 9, wherein said handle assembly includes a proximal end disposed to be manually engaged, and a distal end, a first mounting pin, and means for releasably joining said first mounting pin to said distal end of said main drive link and said distal end of said handle assembly at a selectively variable spacing from said first pivot means.

11. The exercise apparatus of claim 10, further including leg exercise means cooperatively engageable with said handle assembly and said shuttle means to provide leg exercise for the individual using said exercise apparatus.

12. The exercise apparatus of claim 11, wherein said leg exercise means includes third pivot means supported by said column assembly, a leg strut assembly rotatably supported by said third pivot means, and a pair of pedals secured to a proximal end of said leg strut assembly and disposed to engage the feet of the individual using said exercise apparatus.

13. The exercise apparatus of claim 12, further including a second mounting pin and means for releasably joining said second mounting pin to said distal end of said main drive link and the distal end of said leg strut assembly at a selectively variable spacing from said third pivot means.

14. The exercise apparatus of claim 13, further including leg strut linking means joined to said distal end of said leg strut assembly, and means for releasably joining said leg strut linking means to said proximal end of said handle assembly.

15. The exercise apparatus of claim 14, wherein said leg strut assembly includes a pair of leg struts disposed at opposed sides of said column assembly, said leg struts having a generally linear distal end portion and a proximal end portion curved in dogleg fashion.

16. The exercise apparatus of claim 13, wherein said first pivot means is spaced vertically above said second pivot means, and said third pivot means is disposed vertically below said second pivot means.

17. An exercise apparatus, including;

a ground-engaging base assembly;

a column assembly extending upwardly from said base assembly;

a handle assembly; and first pivot means secured to an upper portion of said column assembly for supporting said handle assembly in rotatable fashion;

shuttle means disposed to freely translate longitudinally along said column assembly, a first strut extending from said shuttle means and adapted to support the weight of an individual using said exercise apparatus;

a main drive link, and second pivot means supported on said shuttle means for securing a proximal end of said main drive link;

a leg strut assembly, and third pivot means supported by said column assembly for securing said leg strut assembly in rotatable fashion, and a pair of pedals secured to a proximal end of said leg strut assembly and disposed to engage the feet of the individual using said exercise apparatus;

means for releasably securing the distal end of said main drive link either to a distal end portion of said handle assembly or to a distal end portion of said leg strut assembly, whereby motion of said handle assembly or said leg strut assembly is coupled through said second pivot means to said shuttle means to exert lifting force on said shuttle means in opposition to said weight of the individual using said exercise apparatus.

18. The exercise apparatus of claim 17, further including leg strut linking means having a proximal end and a distal end, said end secured to said distal end of said leg strut assembly, and means for releasably securing said proximal end of said leg strut linking means to a proximal end of said handle assembly.

19. The exercise apparatus of claim 17, wherein said leg strut assembly includes a pair of leg struts disposed at opposed sides of said column assembly, and said handle assembly includes a pair of handle members disposed at said opposed sides of said column assembly.

20. The exercise apparatus of claim 17, wherein said column assembly includes a slot extending longitudinally therein, said shuttle means disposed in said slot and including wheel means disposed to engage interior surfaces of said slot in freely rolling fashion.

21. The exercise apparatus of claim 17, further including a collar assembly extending from said shuttle means and circumscribing said column assembly, said second pivot means supported by said collar assembly.

22. The exercise apparatus of claim 17, further including a seat secured to said first strut to support a seated individual using said exercise apparatus.

23. The exercise apparatus of claim 17, further including a foot step secured to said first strut to support a standing individual using said exercise apparatus.

24. The exercise apparatus of claim 17, wherein said first pivot means is spaced vertically generally above said second pivot means, and said third pivot means is disposed vertically generally below said second pivot means.

25. The exercise apparatus of claim 21, further including linear bearing means extending from said collar assembly to said column assembly for rolling translation therealong.

26. The exercise apparatus of claim 21, further including roller bearing means extending from said collar assembly to said column assembly for rolling translation therealong.

* * * * *